US010968860B2

(12) United States Patent
Favaron

(10) Patent No.: US 10,968,860 B2
(45) **Date of Patent: *Apr. 6, 2021**

(54) CYLINDER LINER HAVING VARIED THERMAL CONDUCTIVITY

(71) Applicant: ZYNP Group (U.S.A.) Inc., Romulus, MI (US)

(72) Inventor: Rodrigo Favaron, Romulus, MI (US)

(73) Assignee: ZYNP GROUP (U.S.A.) INC., Romulus, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/790,837

(22) Filed: Feb. 14, 2020

(65) Prior Publication Data

US 2020/0182187 A1 Jun. 11, 2020

Related U.S. Application Data

(63) Continuation of application No. 15/881,924, filed on Jan. 29, 2018, now Pat. No. 10,677,189.

(60) Provisional application No. 62/451,091, filed on Jan. 27, 2017.

(51) Int. Cl.

| | |
|---|---|
| ***F02F 1/08*** | (2006.01) |
| ***F02F 1/00*** | (2006.01) |
| *B22D 21/00* | (2006.01) |
| *B22D 13/00* | (2006.01) |

(52) U.S. Cl.

CPC ..... *F02F 1/08* (2013.01); *F02F 1/004* (2013.01); *B22D 13/00* (2013.01); *B22D 21/007* (2013.01); *F02F 2200/06* (2013.01); *F05C 2251/048* (2013.01)

(58) Field of Classification Search

CPC ..... F02F 1/08; F02F 1/004; F02F 2200/06; F05C 2251/048; B22D 13/00; B22D 21/007; B22D 25/02

See application file for complete search history.

(56) References Cited

U.S. PATENT DOCUMENTS

| | | | | |
|---|---|---|---|---|
| 4,921,734 | A * | 5/1990 | Thorpe | F02F 7/0087 123/193.2 |
| 7,533,647 | B2 | 5/2009 | Miyamoto et al. | |
| 7,685,987 | B2 | 3/2010 | Miyamoto et al. | |
| 8,037,860 | B2 | 10/2011 | Takami et al. | |
| 9,316,173 | B2 * | 4/2016 | Highum | F02F 1/102 |
| 9,581,103 | B1 | 2/2017 | Qin | |
| 9,850,846 | B1 | 12/2017 | Qin | |

(Continued)

FOREIGN PATENT DOCUMENTS

| | | |
|---|---|---|
| CN | 101829778 A | 9/2010 |
| JP | 2010159768 A | 7/2010 |

(Continued)

*Primary Examiner* — Syed O Hasan

(74) *Attorney, Agent, or Firm* — Michael E. Dockins; Shumaker, Loop & Kendrick, LLP

(57) ABSTRACT

Provided is a cylinder liner having a first portion with a first thermal conductivity and a second portion with a second thermal conductivity. The first portion having the first thermal conductivity can include as-cast projections or a coating of a material, as desired. The first thermal conductivity can be greater than the second thermal conductivity. In this manner, the cylinder liner can exhibit a thermal conductivity gradient.

19 Claims, 9 Drawing Sheets

(56) References Cited

U.S. PATENT DOCUMENTS

| | | | | |
|---|---|---|---|---|
| 2003/0056645 | A1* | 3/2003 | Land | F02F 1/004 123/193.2 |
| 2006/0156917 | A1* | 7/2006 | Oda | F02F 1/004 92/171.1 |
| 2007/0012175 | A1* | 1/2007 | Miyamoto | B22D 19/0009 92/171.1 |
| 2007/0012178 | A1 | 1/2007 | Takami et al. | |
| 2015/0122118 | A1* | 5/2015 | He | B22D 13/02 92/171.1 |
| 2015/0211409 | A1 | 7/2015 | Makino | |
| 2017/0107933 | A1* | 4/2017 | Favaron | F02F 1/004 |
| 2018/0283309 | A1* | 10/2018 | Kamat | B22D 19/0009 |

FOREIGN PATENT DOCUMENTS

| | | | |
|---|---|---|---|
| JP | 2014238044 | A | 12/2014 |
| WO | 20005038073 | A2 | 4/2005 |

* cited by examiner

CYLINDER LINER HAVING VARIED THERMAL CONDUCTIVITY

CROSS-REFERENCE TO RELATED APPLICATIONS

This application is a continuation application of U.S. patent application Ser. No. 15/881,924, filed on Jan. 29, 2018, which claims the benefit of U.S. Provisional Application No. 62/451,091, filed on Jan. 27, 2017. The entire disclosures of the above applications are incorporated herein by reference.

FIELD

The present technology relates to a cylinder liner having varied thermal conductivity and a process for forming the same.

INTRODUCTION

This section provides background information related to the present disclosure which is not necessarily prior art.

Proper temperature management can optimize durability and performance of an internal combustion engine. Thermal conductivity of different portions of the internal combustion engine can be varied to improve temperature management. In certain internal combustion engines, a water jacket can be formed around a cylinder bore of a cylinder block of a liquid-cooled internal combustion engine. Liquid coolant can be circulated in the water jacket to cool a cylinder bore wall that is subjected to temperature changes during operation of the engine. A water jacket spacer can be inserted in the water jacket and can exchange heat with the cylinder bore wall by adjusting the flow of liquid coolant. As such, appropriate temperature management including cooling of the cylinder bore wall can be achieved using the water jacket spacer. However, design of the water jacket can include a coolant introduction port at a location in the water jacket, where a lower portion of the cylinder bore wall can at times be excessively cooled by the liquid coolant flowing into the back (on the cylinder bore side) of the water jacket spacer. When the lower portion of the cylinder bore wall opposite to the coolant introduction port is excessively cooled, the viscosity of engine oil can increase at this location or the sliding resistance of a piston ring and a cylinder liner can increase by deformation of the cylinder bore, thereby lowering energy efficiency.

Various cylinder blocks and cylinder liners, including cylinder liners having as-cast protections, can include a water jacket spacer configured to improve temperature management and minimize excessive cooling of the lower portion of the cylinder bore. Examples include the water jacket spacer disclosed in U.S. Pub. No. 2015/0211409A1 to Makino for WATER JACKET SPACER. In brief, a water jacket spacer can be configured to adjust a flow of liquid coolant in a water jacket, where the water jacket spacer is inserted into the water jacket of a cylinder block. The water jacket spacer includes a spacer body and a rectification means inhibiting the flow of liquid coolant into an inner wall on a cylinder bore side of the water jacket. The rectification means has a form of a pocket and is provided on a face of the spacer body, the face being on a side of a cooling water introduction port of the water jacket, the rectification means being provided lower than the cooling water introduction port in a depth direction. The purpose of the water jacket spacer is to prevent excessive cooling at the cylinder bore wall around the cooling water introduction port.

Use of a water jacket spacer, however, adds additional parts, assembly, and complexity to the design of an internal combustion engine. It would be desirable to develop a cylinder liner with heat transfer capabilities that would obviate the need for the addition of a water jacket spacer in an engine block.

SUMMARY

The present technology includes articles of manufacture, systems, and processes that relate to a cylinder liner where thermal conductivity can be optimized at various portions of the cylinder liner. In this way, the cylinder liner having varied thermal conductivity can improve temperature management and minimize excessive cooling of a lower portion of a cylinder bore of a liquid-cooled internal combustion engine.

A cylinder liner having varied thermal conductivity is provided that includes a cylindrical body, an outer surface of the cylindrical body, a first portion on the outer surface of the cylindrical body, and a second portion on the outer surface of the cylindrical body. The first portion has a first thermal conductivity and the second portion has a second thermal conductivity, where the first thermal conductivity is different from the second thermal conductivity. In this manner, the cylinder liner can exhibit a thermal conductivity gradient. For example, the first thermal conductivity can be greater than the second thermal conductivity. The first portion can also define a first circumferential portion of the cylindrical body and the second portion can define a second circumferential portion of the cylindrical body. The first portion can be adjacent a first end of the cylindrical body and the second portion can be adjacent a second end of the cylindrical body.

The first and second portions of the outer surface of the cylinder liner can also incorporate the following aspects. The first portion of the outer surface of the cylinder liner can include a plurality of as-cast projections or a coating. The plurality of as-cast projections can include (a) projections having a first diameter adjacent to the surface of the cylinder liner, a second diameter spaced apart from the first diameter and terminating at an end of the projection, and a third diameter therebetween less than the first and the second diameters; (b) conjoined projections, each of the conjoined projections having a plurality of peaks, each peak sharing a shoulder with another peak; and/or (c) vermicular projections, each of the vermicular projections having a non-circular cross-section substantially planar to the outer surface. The coating can include aluminum and can further include magnesium, where the coating can be an alloy of aluminum and magnesium. The first portion can include a first plurality of as-cast projections and the second portion can include a second plurality of as-cast projections, where the first plurality of as-cast projections have a greater average height than the second plurality of as-cast projections. The second portion of the outer surface of the cylinder line can also be devoid of as-cast projections and can be defined by a substantially smooth surface, a ribbed surface, or a threaded surface.

The cylinder liner can further include additional portions, such as a third portion on the outer surface of the cylindrical body, where the third portion has a third thermal conductivity. The third thermal conductivity can be different from the first thermal conductivity and the second thermal conductivity or can be substantially similar to one of the first thermal conductivity and the second thermal conductivity.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 8:
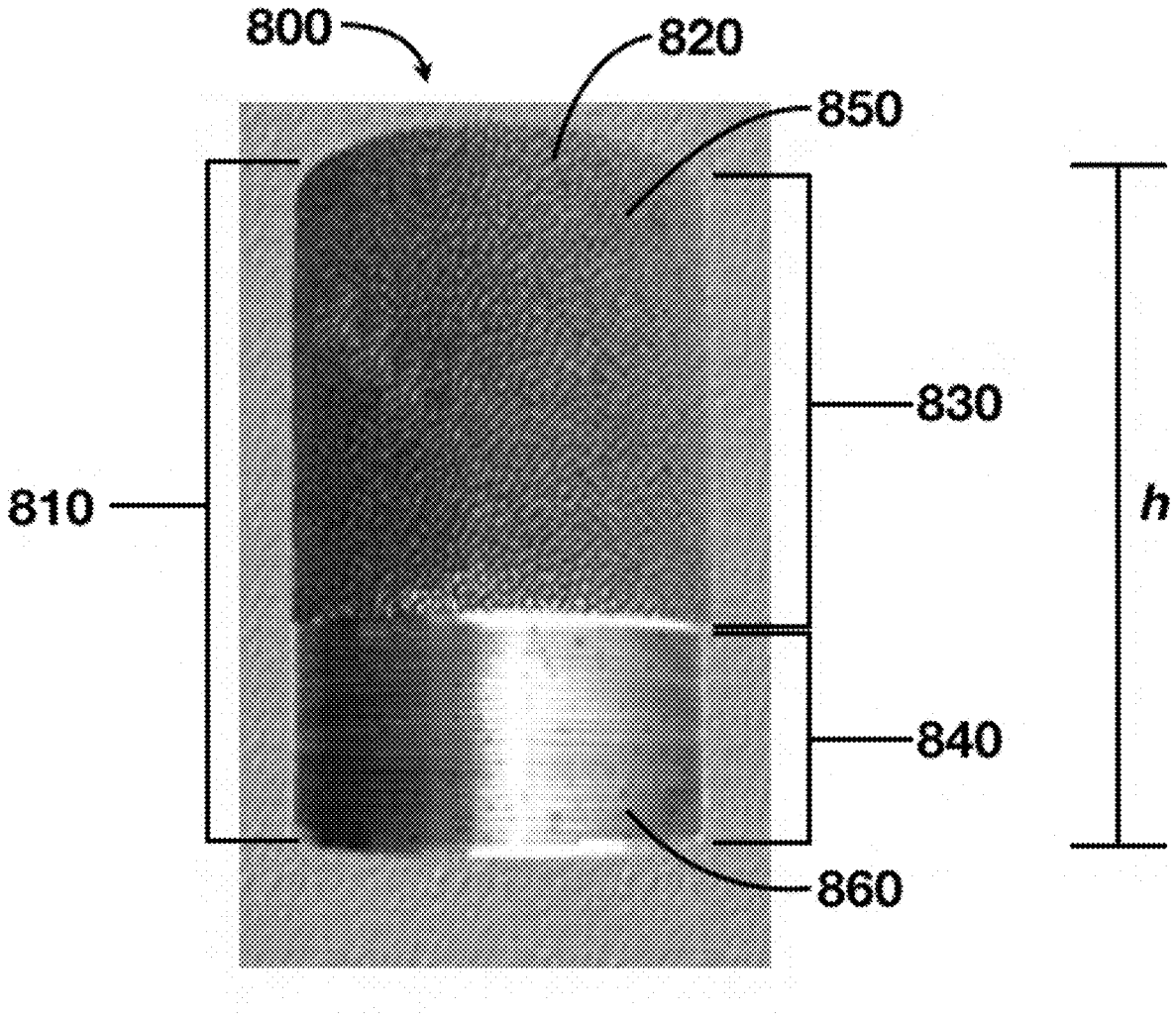

FIG. 8 is an embodiment of cylinder liner having varied thermal conductivity including a first portion on the outer surface of the cylindrical body, the first portion having a first thermal conductivity provided by a plurality of as-cast projections, and a second portion on the outer surface of the cylindrical body, the second portion having a second thermal conductivity provided by removal of as-cast projections, the first thermal conductivity being different from the second thermal conductivity.

Figure 9:
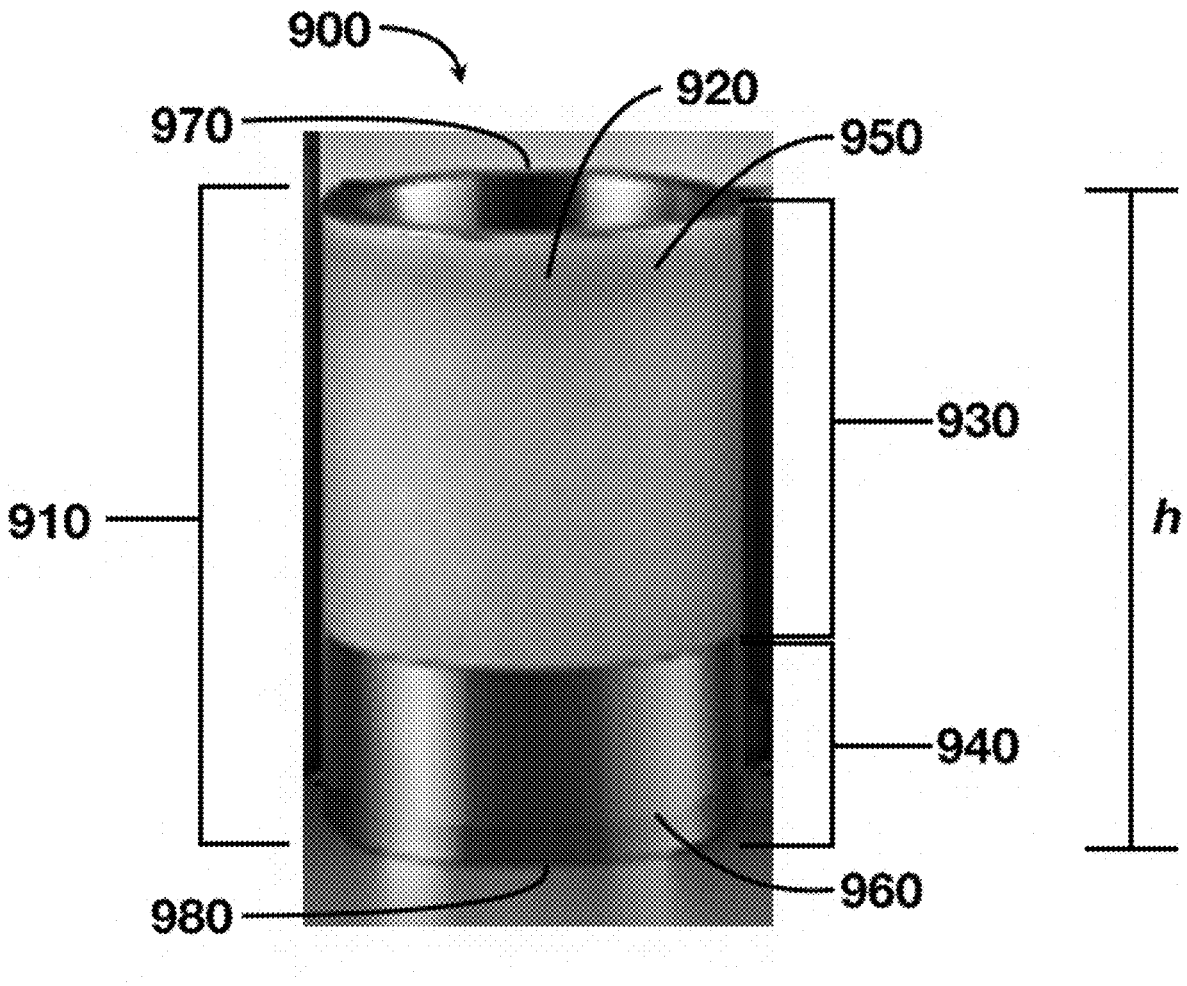

FIG. 9 is an embodiment of a cylinder liner having varied thermal conductivity including a first portion on the outer surface of the cylindrical body, the first portion having a first thermal conductivity provided by a coating, and a second portion on the outer surface of the cylindrical body, the second portion having a second thermal conductivity that is not coated, the first thermal conductivity being different from the second thermal conductivity.

DETAILED DESCRIPTION

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. Regarding methods disclosed, the order of the steps presented is exemplary in nature, and thus, the order of the steps can be different in various embodiments. "A" and "an" as used herein indicate "at least one" of the item is present; a plurality of such items may be present, when possible. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters.

All documents, including patents, patent applications, and scientific literature cited in this detailed description are incorporated herein by reference, unless otherwise expressly indicated. Where any conflict or ambiguity may exist between a document incorporated by reference and this detailed description, the present detailed description controls.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of" Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application. For example, recitation of a composition or process reciting elements A, B and C specifically envisions embodiments consisting of, and consisting essentially of, A, B and C, excluding an element D that may be recited in the art, even though element D is not explicitly described as being excluded herein.

As referred to herein, all compositional percentages are by weight of the total composition, unless otherwise specified. Disclosures of ranges are, unless specified otherwise, inclusive of endpoints and include all distinct values and further divided ranges within the entire range. Thus, for example, a range of "from A to B" or "from about A to about B" is inclusive of A and of B. Disclosure of values and ranges of values for specific parameters (such as amounts, weight percentages, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that Parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, 3-9, and so on.

The present technology improves a cylinder liner that can be used in a cylinder bore of a cylinder block of a liquid-cooled internal combustion engine. The cylinder liner exhibits varied thermal conductivity and can include a cylindrical body having an outer surface. A first portion on the outer surface of the cylindrical body has a first thermal conductivity. A second portion on the outer surface of the cylindrical body has a second thermal conductivity. The first thermal conductivity is different from the second thermal conductivity. The different thermal conductivities can result from improving heat transfer in one portion of the cylinder liner versus another portion of the cylinder liner and/or reducing heat transfer in one portion of the cylinder liner versus another portion of the cylinder liner. In this way, the cylinder liner can exhibit a substantially constant or uniform temperature across such portions or even throughout the cylinder liner. Thermal management afforded by the cylinder liner having varied thermal conductivity can minimize cylinder bore deformation resulting from one or more temperature gradients. The present technology can therefore minimize friction, lubricant oil consumption, and blow-by (passage of combustion gases between the cylinder liner and the piston and piston rings) in the engine. The cylinder liner having varied thermal conductivity can further eliminate the need to use a water jacket spacer in an engine block.

The first portion on the outer surface of the cylindrical body of the cylinder liner can exhibit the following aspects. The first thermal conductivity of the first portion can be greater than the second thermal conductivity of the second portion. The first portion can define a circumferential portion of the cylindrical body. The first portion can be adjacent a first end of the cylindrical body where the second portion can be adjacent a second end of the cylindrical body. The first portion can include a plurality of as-cast projections. The plurality of as-cast projections can include projections having a first diameter adjacent to the surface of the cylinder liner, a second diameter spaced apart from the first diameter and terminating at an end of the projection, and a third diameter therebetween less than the first and the second diameters. For example, the as-cast projections can be lightbulb or mushroom shaped. The plurality of as-cast projections can include conjoined projections, where each of the conjoined projections has a plurality of peaks, each peak sharing a shoulder with another peak. The plurality of as-cast projections can include vermicular projections, where each of the vermicular projections has a non-circular cross-section substantially planar to the outer surface. The plurality of as-cast projections can also include combinations of the aforementioned projections. The first portion can also include a coating, where the coating includes aluminum and can further include magnesium; e.g, thermal sprayed coating of AlMg5 alloy.

The second portion on the outer surface of the cylindrical body of the cylinder liner can exhibit the following aspects. The second portion can define a circumferential portion of the cylindrical body. For example, the first portion can define a first circumferential portion of the cylindrical body and the second portion defines a second circumferential portion of the cylindrical body, where the first circumferential portion includes greater than half the height of the cylindrical body. The first portion can include a first plurality of as-cast projections and the second portion can include a second plurality of as-cast projections, where the first plurality of as-cast projections have a greater average height than the second plurality of as-cast projections. In this manner, the different average heights of the as-cast projections result in different thermal conductivities between the respective portions of the cylinder liner and the cylinder block. The second portion can also be devoid of as-cast projections. Alternatively, the second portion can be defined by a substantially smooth surface or include a ribbed or threaded surface.

The outer surface of the cylindrical body of the cylinder liner having varied thermal conductivity can also include additional portions thereon. For example, the cylinder liner can have a third portion on the outer surface of the cylindrical body, where the third portion has a third thermal conductivity. The third thermal conductivity can be different from the first thermal conductivity and the second thermal conductivity. Alternatively, the third thermal conductivity of the third portion can be the same as one of the first thermal conductivity of the first portion and the second thermal conductivity of the second portion. In this case, the portions having the same thermal conductivity can be at least partially separated by the portion having the different thermal conductivity to provide a region of discontinuous thermal conductivity. The cylinder liner can also be constructed with more than three outer surface portions (e.g., four, five, six, and so on) with each portion having a different thermal conductivity, including embodiments where there are alternating thermal conductivities (e.g., three portions with two portions each having the same thermal conductivity $K_1$ separated by a portion having a different thermal conductivity $K_2$ disposed between), or the cylinder liner outer surface can have a thermal conductivity gradient provided by three or more portions that provides thermal conductivities that increase or decrease one or more times along a length thereof. Examples include arrangements of portions having thermal conductivities ($K_N$) as follows: (a) $K_1$-$K_2$-$K_1$, (b) $K_1$-$K_2$-$K_3$, (c) $K_1$-$K_2$-$K_3$-$K_4$, and so on.

As-cast projections can be formed using a centrifugal casting process for the cylinder liner. During the centrifugal casting, a coating can be formed on the casting mold. The coating can be formed from a porous material that results in the as-cast projections due to the pores on a surface of the coating that contact and entrain a portion of a molten metal poured thereon and in contact therewith. The density, torosity, degree of porosity, and thickness of the porous material can determine the height, shape, and density of the as-cast projections formed on the cylinder liner.

A molten metal having a desired composition can be poured into the mold onto the coating. The molten metal can include aluminum, a gray cast iron (GCI), a GO/aluminum alloy, or another alloy, as desired. In the event that engine block intended for the cylinder liner is formed from aluminum, molten metal including aluminum is preferred to form the cylinder liner. The molten metal can also be formed from an austempered ductile cast iron (ADI) similar to that disclosed in commonly-owned U.S. Pat. No. 9,850,846 to Qin for CYLINDER LINER AND METHOD OF FORMING THE SAME, and the cylinder liner can include aspects of U.S. Pat. No. 9,581,103 to Qin for CYLINDER LINER AND METHOD OF FORMING THE SAME.

Figure 1:
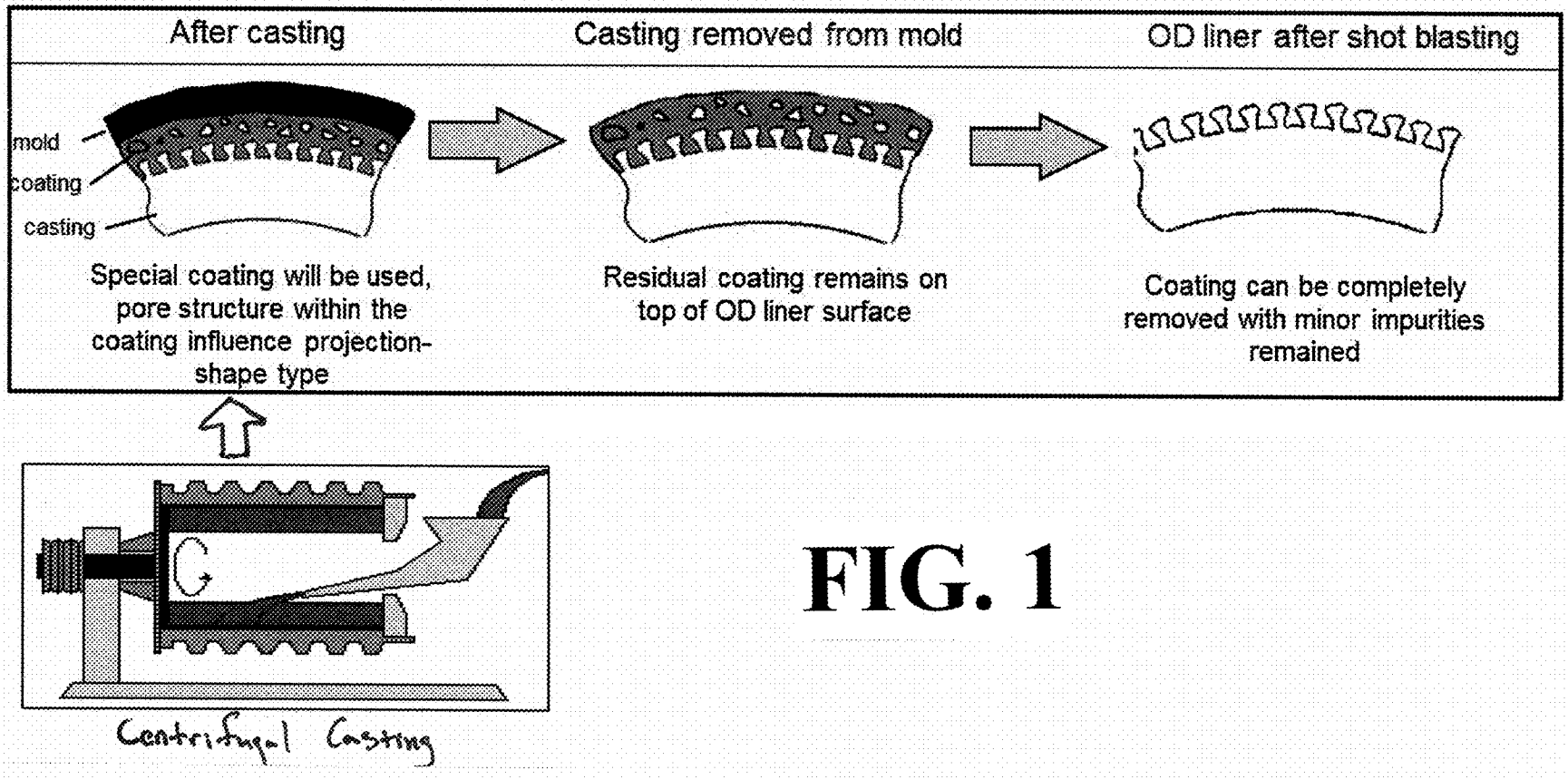
FIG. 1 is a flow chart depicting an embodiment of a process for forming a cylinder liner having varied thermal conductivity where a portion of the outer surface of the cylindrical body has as-cast projections formed thereon.

The molten metal-covered coating can be applied using a centrifugal casting process. Once the centrifugal casting is completed, the cylinder liner having the coating thereon is removed from the mold. The coating can be removed from the cylinder liner using a shot blasting process to provide a cylinder liner having an outer surface (or outer diameter, OD) substantially free from the coating material and having as-cast projections formed thereon. The process is generally illustrated in FIG. 1. The coating can also be removed using a sand blasting process, a chemical removal step, or any suitable process for removing the coating.

The as-cast projections formed on one or more portions of the outer surface of the cylindrical body of the cylinder liner can include a member selected from the group consisting of: (a) projections having a lightbulb or mushroom-like shape with a first diameter adjacent to the surface of the cylinder liner, a second diameter spaced apart from the first diameter and terminating at an end of the projection, and a third diameter therebetween less than the first and the second diameters; (b) conjoined projections, each of the conjoined projections including a plurality of peaks, each peak sharing a shoulder with another peak; (c) vermicular projections, each of the vermicular projections having a cross-section substantially planar to the outer surface that is non-circular; and (d) combinations thereof. The as-cast projections can include at least two of (a), (b), and (c). The as-cast projections can also include each of (a), (b), and (c). The as-cast projections can various percentages of each (a), (b), and (c), where respective percentages can range from about 1% to about 100%. The as-cast projections can also include from about 10 as-cast projections per square centimeter to about 100 as-cast projections per square centimeter of outer surface.

Where the as-cast projections include conjoined projections, the following aspects can apply. Each of the conjoined projections includes a plurality of peaks, where each peak shares a shoulder with another peak. The portion of the as-cast projections being conjoined projections can include about one-quarter of a total number of the plurality of as-cast projections, about one-half of a total number of the plurality of as-cast projections, about three-quarters of a total number of the plurality of as-cast projections, and substantially all of the plurality of as-cast projections. The conjoined projections can include conjoined projections having at least three peaks, at least four peaks, and more than four peaks. The plurality of peaks can vary in height by less than about 25% and can have a substantially similar height. The plurality of peaks can have a height from about 0.25 mm to about 0.75 mm. A lowest point of the shoulder shared between the peak and the another peak can include about one-quarter of a height of one of the peak and the another peak, can include about one-half of a height of one of the peak and the another peak, and can include about three-quarters of a height of one of the peak and the another peak. The plurality of as-cast projections can include from about 10 as-cast projections per square centimeter to about 100 as-cast projections per square centimeter. Likewise, the portion of the as-cast projections being conjoined projections can include from about 10 conjoined projections per square centimeter to about 100 conjoined projections per square centimeter.

Where the as-cast projections include vermicular projections, the following aspects can apply. Each of the vermicular projections can have a cross-section substantially planar to the outer surface that is non-circular. The cross-section can be multi-lobed and can be elongate and curved. Examples of such cross-sections include C-shapes, S-shapes, kidney shapes, multi-lobed shapes including shapes having two lobes, three lobes, four lobes, and more than four lobes, shapes having multiple curves and turns including various sinuous and winding shapes. The portion of vermicular projections can include about one-quarter of a total number of the plurality of as-cast projections, about one-half of a total number of the plurality of as-cast projections, about three-quarters of a total number of the plurality of as-cast projections, and substantially all of the plurality of as-cast projections. The portion of the vermicular projections can have a substantially similar height and can have a height from about 0.25 mm to about 0.75 mm. The vermicular projections can have a single peak and can include where the vermicular projections have a substantially constant height. The vermicular projections can include from about 10 as-cast projections per square centimeter to about 100 as-cast projections per square centimeter. Likewise, the portion of vermicular projections can include from about 10 vermicular shapes per square centimeter to about 100 vermicular shapes per square centimeter.

Figure 2:
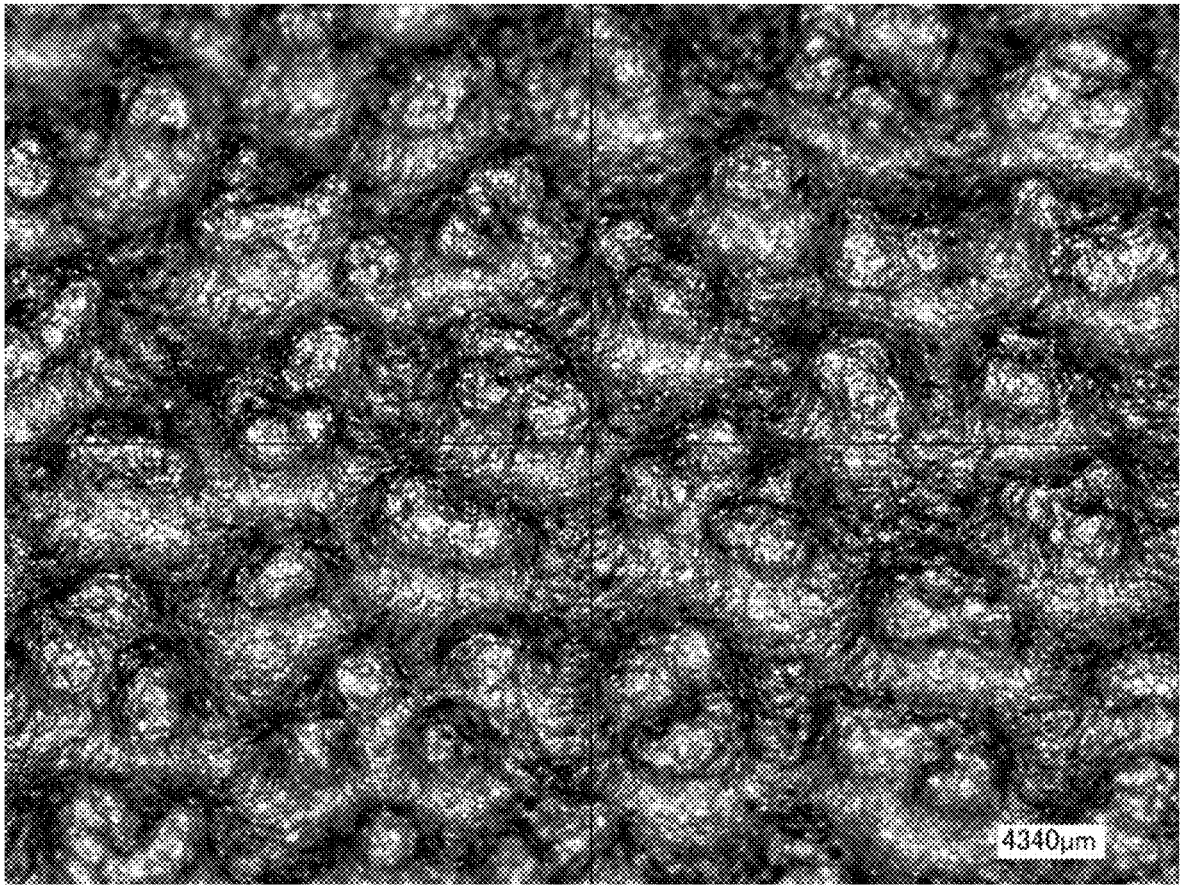
FIG. 2 is a photomicrograph of an embodiment of a portion of an outer surface of a cylindrical body having as-cast projections.
Figure 3:
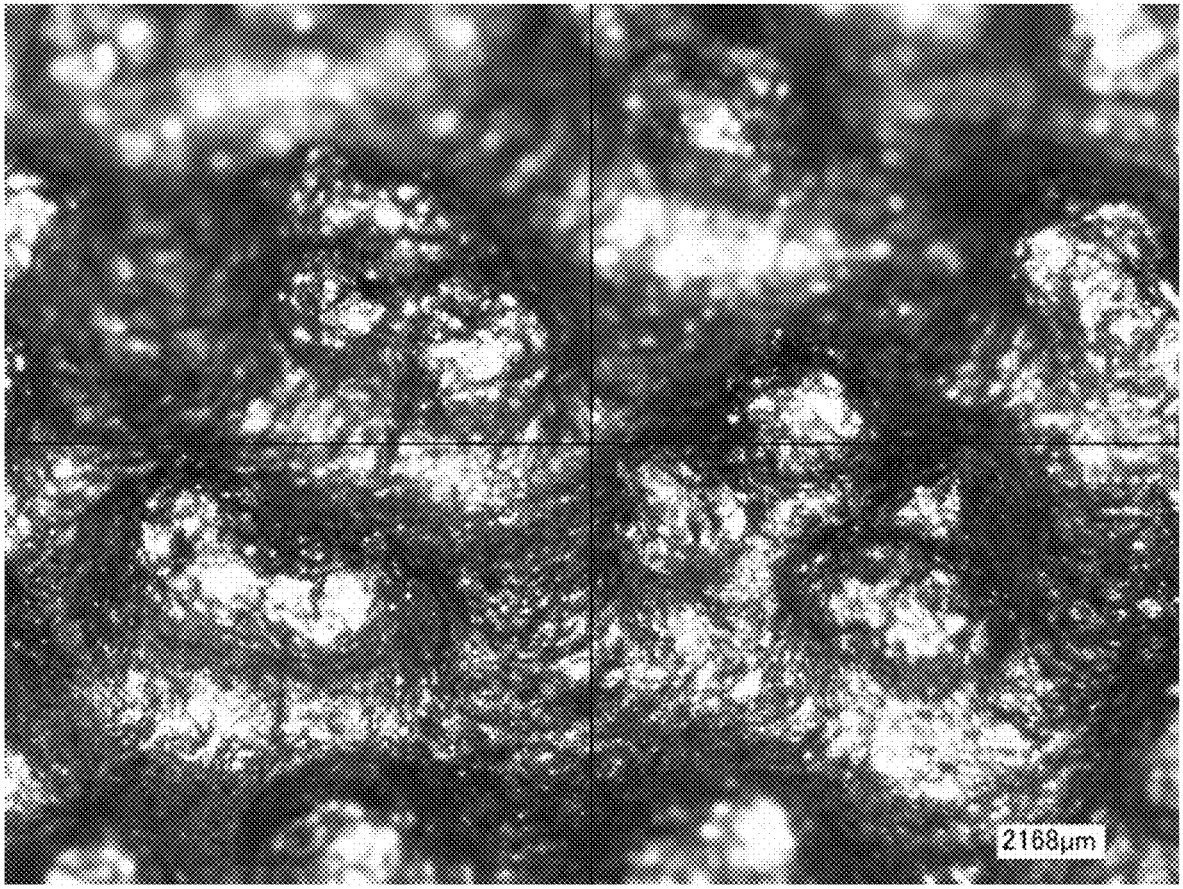
FIG. 3 is a photomicrograph of a central portion of FIG. 2 at a higher magnification.

Examples of a portion of the outer surface of the cylinder liner having a plurality of as-cast projections formed thereon are shown in FIGS. 2-3, where the as-cast projections include projections having a mushroom or lightbulb-like shape, conjoined projections, and vermicular projections. The methods of forming a cylinder liner having as-cast projections as described herein can be tailored to optimize the physical parameters of the as-cast projections, the shape or type of the as-cast projections, and the number and respective portions of shapes or types of the as-cast projections on the outer surface of the cylinder liner. FIG. 2 is a photomicrograph of the outer surface of the cylinder liner and FIG. 3 is photomicrograph of the central portion of FIG. 2 at a higher magnification.

Figure 4:
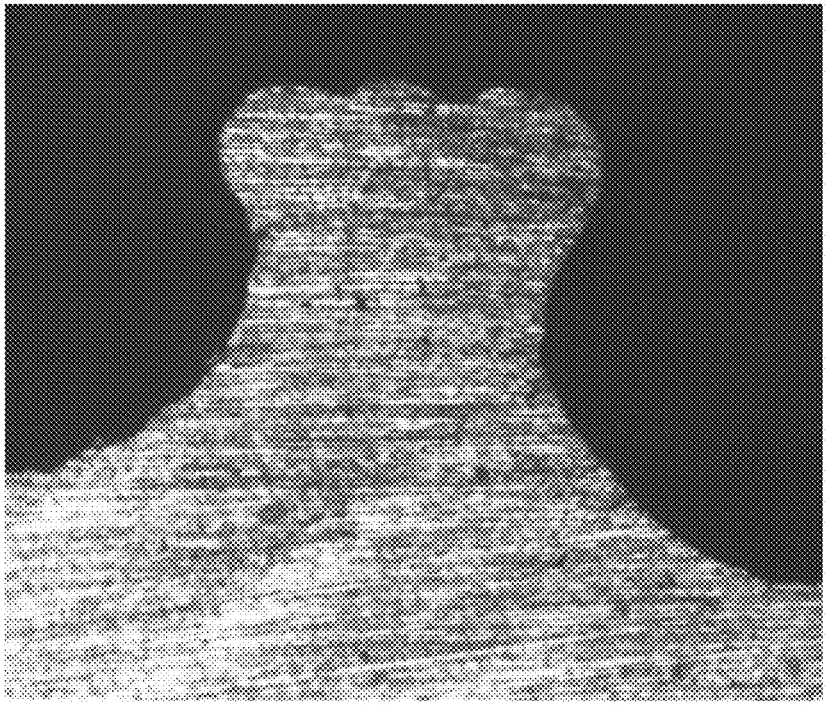
FIG. 4 is a photomicrograph of an embodiment of vertical cross-section of a projection having a first diameter adjacent to the surface of the cylinder liner, a second diameter spaced apart from the first diameter and terminating at an end of the projection, and a third diameter therebetween less than the first and the second diameters.
Figure 5:
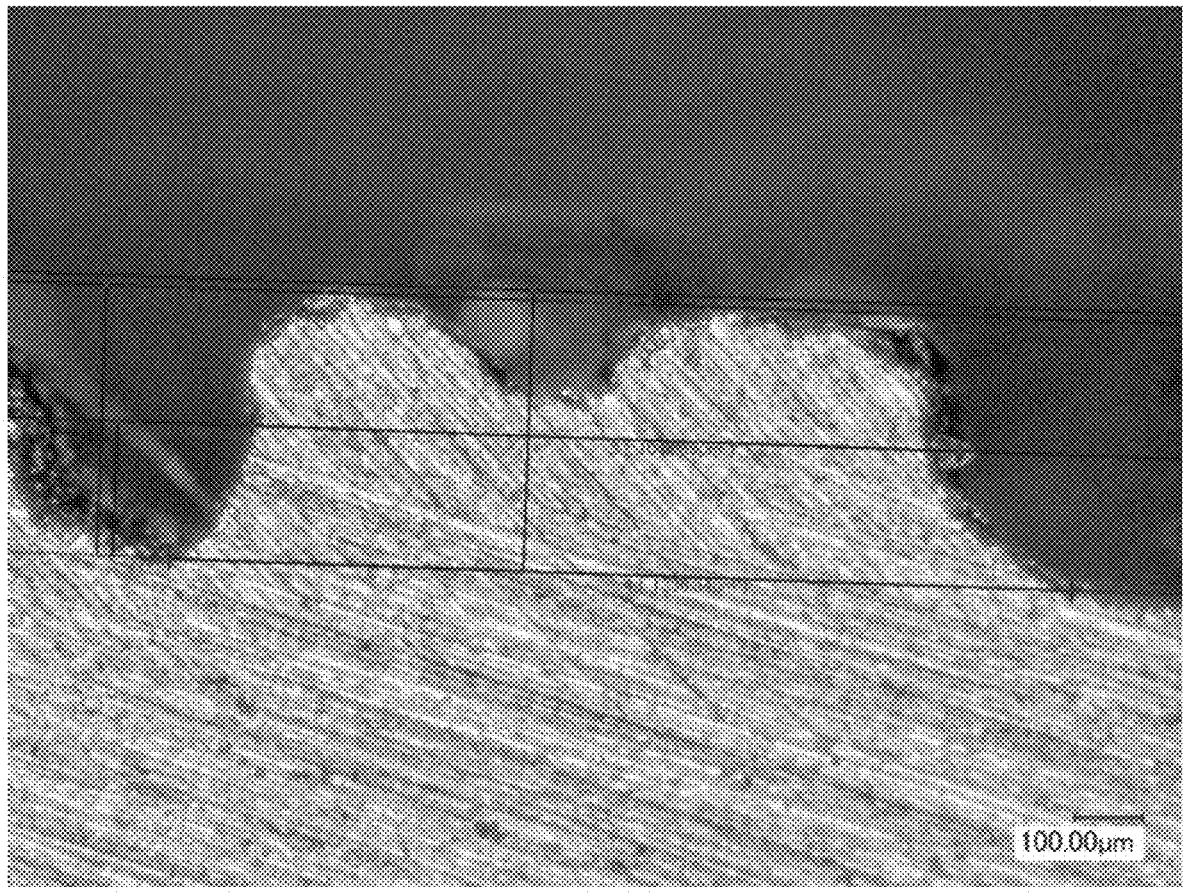
FIG. 5 is a photomicrograph of an embodiment of a vertical cross-section of a conjoined projection.
Figure 6:
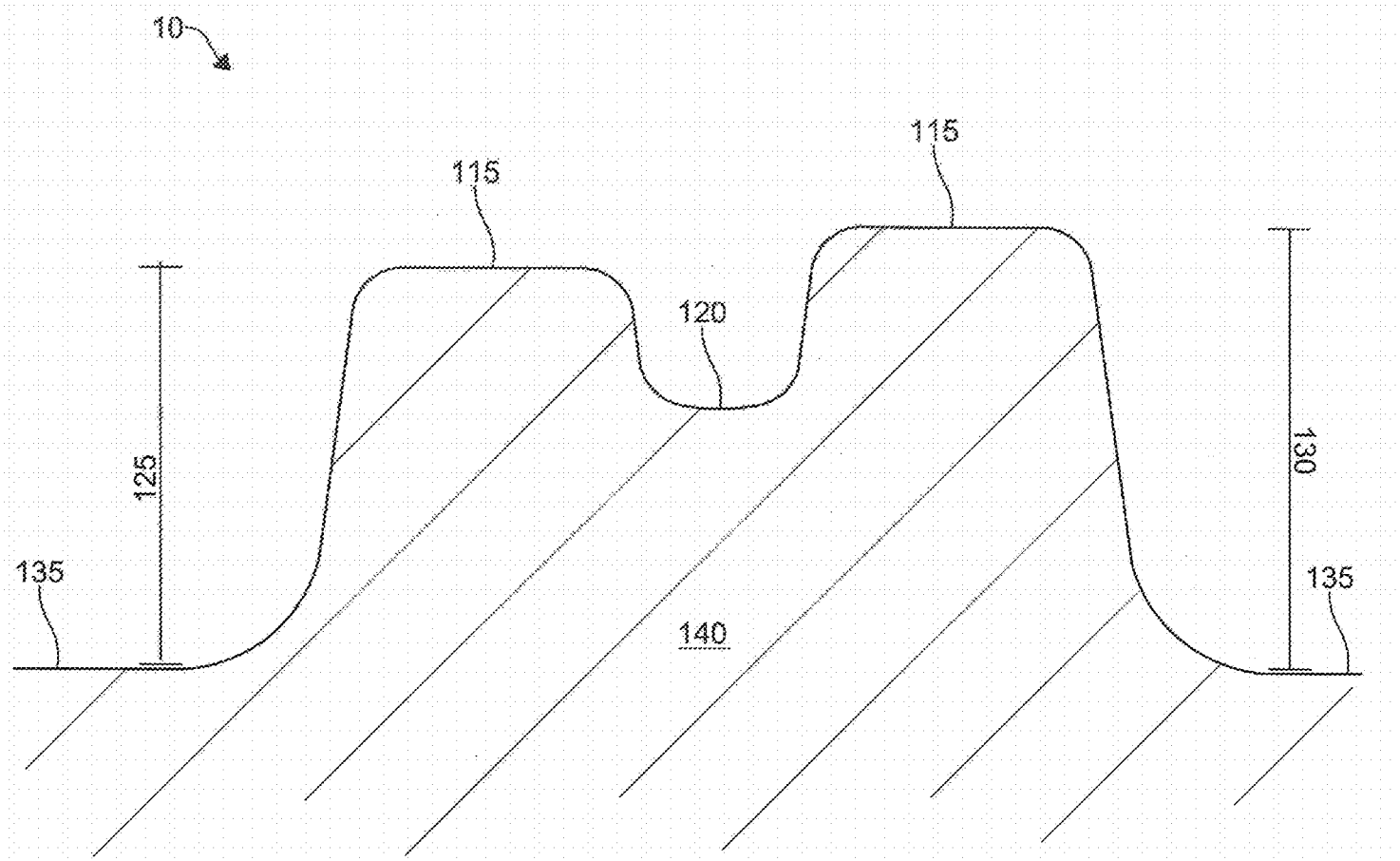
FIG. 6 is a schematic illustrating various aspects of the conjoined projection of FIG. 5.
Figure 7:
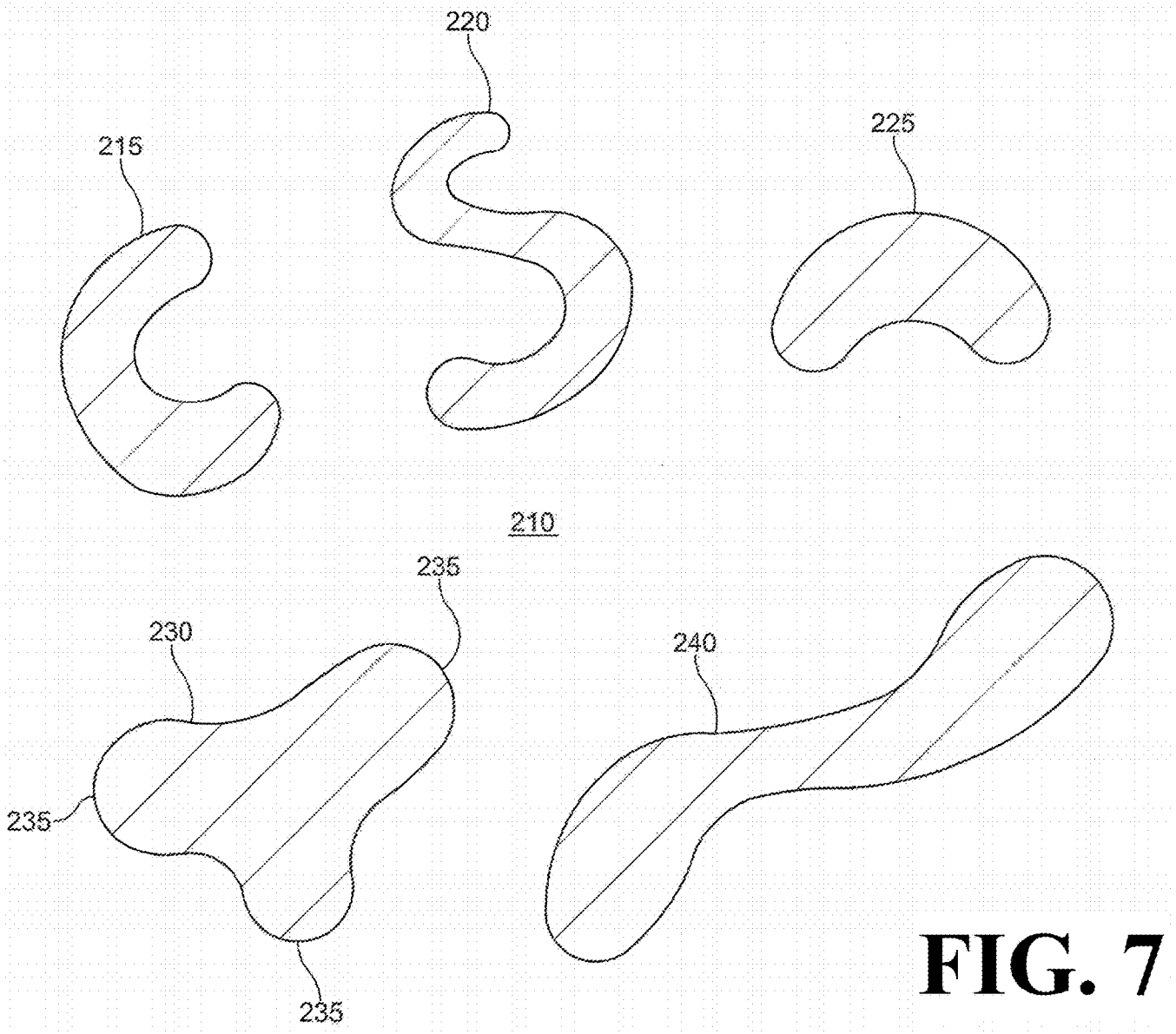
FIG. 7 is a schematic of various embodiments of vermicular projections having various cross-sections taken substantially planar to the outer surface of the cylinder liner.

FIGS. 4-7 depict the different types of as-cast projections that can be formed on the outer surface of the cylinder liner. FIG. 4 is a photomicrograph of a vertical cross-section of a mushroom or lightbulb shaped projection, where such a projection can have a first diameter adjacent to the surface of the cylinder liner, a second diameter spaced apart from the first diameter and terminating at an end of the projection, and a third diameter therebetween less than the first and the second diameters. FIG. 5 is a photomicrograph of a vertical cross-section of a conjoined projection, where FIG. 6 is a schematic thereof illustrating various aspects of the conjoined projection at 10. The vertical cross-section of the conjoined projection 10 shows two peaks 115 that share a shoulder 120. The two peaks 115 have substantially similar heights 125, 130 in projecting from the outer surface 135 of the cylinder liner 140. However, the peaks 115 could have different heights and/or one or both of the peaks 115 could share one or more shoulders 120 with one or more peaks 115 having different heights. The shoulder 120 shown between the peaks 115 is about three-quarters of the height 125, 130 of one of the peaks 115. The shoulder 120, however, could also have a height ranging between about 10% to about 90% of the height 125, 130 of one of the peaks 115. FIG. 7 is a schematic of various cross-sections of vermicular projections taken substantially planar to the outer surface of the cylinder liner showing the non-circular shape thereof. The outer surface 210 of the cylinder liner includes cross-sections of vermicular projections that are C-shaped 215, S-shaped 220, kidney shaped 225, multi-lobed 230 having three lobes 235, and a shape 240 having multiple turns and curves. It is noted that the cross-section of a vermicular projection can have a shape that is different from the examples shown in the figure with the caveat that the cross-section taken substantially planar to the outer surface of the cylinder liner is non-circular.

Examples of as-cast projections include those described and shown in commonly-owned U.S. application Ser. No. 15/391,943 to Favaron for CYLINDER LINER.

As described herein, a portion of the outer surface of the cylindrical body of the cylinder liner can have a coating thereon. The coating can be applied in various ways, including various thermal spraying techniques. Thermal spraying includes coating processes in which melted (or heated) materials are sprayed onto a surface. A feedstock or coating precursor can be heated by electrical means (e.g., plasma, arc) or chemical means (e.g. combustion, flame). Suitable feedstocks include various metals and alloys, including aluminum and aluminum alloys such as aluminum alloys including magnesium and/or silicon. Thermal spraying can be used to provide thicker coatings (e.g., 20 micrometers to several mm, depending on the process and feedstock), over a large area at a high deposition rate compared to other coating processes, such as electroplating and physical and chemical vapor deposition. Coating materials suitable for thermal spraying include metals, alloys, ceramics, and composites that can be fed in powder or wire form, heated to a molten or semi-molten state, and accelerated towards the outer surface of the cylinder liner in the form of micrometer-size particles. Combustion or electrical arc discharge can be used as the source of energy for thermal spraying. The final coating can result from the accumulation of numerous sprayed particles on the outer surface. Thermal spray parameters can also be adjusted to tailor a roughness of the resulting coating. Depending on the feedstock or coating precursor, the coating can increase the thermal conductivity of the portion of the outer surface of the cylindrical body to which it is applied, or the coating can decrease the thermal conductivity of the portion of the outer surface of the cylindrical body to which it is applied. The feedstock or coating precursor can therefore be selected to provide one or more portions on the outer surface of the cylindrical body of the cylinder liner, where these portions can have various thermal conductivities.

EXAMPLES

Example embodiments of the present technology are provided with reference to the figures enclosed herewith.

With reference to FIG. 8 an embodiment of a cylinder liner having varied thermal conductivity is shown at 800. The cylinder liner 800 includes a cylindrical body 810 having an outer surface 820, a first portion 830 on the outer surface 820 of the cylindrical body 810, and a second portion 840 on the outer surface 820 of the cylindrical body 810. The first portion 830 has a first thermal conductivity and the second portion 840 has a second thermal conductivity, where the first thermal conductivity is different from the second thermal conductivity. The first portion 830 defines a first circumferential portion 850 of the cylindrical body 810 and the second portion 840 defines a second circumferential portion 860 of the cylindrical body 810. Here, the first circumferential portion 850 includes greater than half the height h of the cylindrical body 810. In the particular embodiment shown, the first circumferential portion 850 includes 60% of the height h of the cylindrical body 810, and the second circumferential portion 860 includes 40% of the height h of the cylindrical body 810. The first portion 830 on the outer surface 820 includes a plurality of as-cast projections and the second portion 840 on the outer surface 820 is devoid of as-cast projections, which results in the first thermal conductivity being greater than the second thermal conductivity. The second portion 840 includes a threaded surface. The as-cast projections on the first portion 830 include projections having a first diameter adjacent to the outer surface 820 of the cylindrical body 810, a second diameter spaced apart from the first diameter and terminating at an end of the projection, and a third diameter therebetween less than the first and the second diameters; an example includes the projection shown in FIG. 4. The as-cast projections have heights from the outer surface 820 of the cylindrical body 810 from 0.3 mm to 0.7 mm. Other embodiments include heights from 0.5 mm to 0.9 mm. Particular height values within these ranges can also represent the average height of the projections. In the particular embodiment shown, the second portion 840 was formed by machining away as-cast projections on the outer surface 820 of the cylindrical body 810 and machining a threaded surface thereon. The threaded surface can increase a shear strength force between the cylinder liner 800 and a cylinder block.

With reference to FIG. 9, another embodiment of a cylinder liner having varied thermal conductivity is shown at 900. The cylinder liner 900 includes a cylindrical body 910 having an outer surface 920, a first portion 930 on the outer surface 920 of the cylindrical body 910, and a second portion 940 on the outer surface 920 of the cylindrical body 910. The first portion 930 has a first thermal conductivity and the second portion 940 has a second thermal conductivity, where the first thermal conductivity is greater than the second thermal conductivity. The first portion 930 defines a first circumferential portion 950 of the cylindrical body 910 and the second portion 940 defines a second circumferential portion 960 of the cylindrical body 910. As can be seen, the first portion 930 is adjacent a first end 970 of the cylindrical body 910 and the second portion 940 is adjacent a second end 980 of the cylindrical body 910. The first portion 930 includes a coating thereon, where the coating includes aluminum. In other embodiments, the coating on the first portion 930 can further include magnesium or silicon, including alloys of aluminum and magnesium, aluminum and silicon, and aluminum, magnesium, and silicon. The second portion 940 includes a ribbed surface thereon, where the ribbed surface can take the form of a continuous thread in certain embodiments. The coating on the first portion 930 is applied by thermal spraying an aluminum based alloy. For example, the cylinder liner 900 can have an entirely threaded surface where the first portion 930 is coated by thermal spraying with an aluminum silicon alloy to provide a coating of 0.2 mm in thickness covering 60% of the total liner height running from the first end 970 to the second end 980. Other embodiments include where the cylinder liner 900 has a wall thickness of 1 mm and is thermally sprayed on the first portion 930 with an aluminum alloy to provide a coating having a thickness of 0.2 mm. This can provide a total wall thickness of the cylinder liner 900 after honing of 1.0 mm, formed by a cast iron cylinder liner 900 of 0.8 mm thickness plus an aluminum alloy coating thickness of 0.2 mm. Yet other embodiments include where the thermally sprayed coating is formed from an aluminum and magnesium alloy, such as AlMg5%.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. Equivalent changes, modifications and variations of some embodiments, materials, compositions and methods can be made within the scope of the present technology, with substantially similar results.

What is claimed is:

1. A cylinder liner having varied thermal conductivity comprising: a cylindrical body; an outer surface of the cylindrical body; a first portion on the outer surface of the cylindrical body, the first portion disposed adjacent a top end of the cylindrical body, the first portion defining a first circumferential portion of the cylindrical body, the first circumferential portion including greater than half a height of the cylindrical body, the first portion having a first thermal conductivity; and a second portion on the outer surface of the cylindrical body, the second portion disposed adjacent a bottom end of the cylindrical body, the second portion defining a second circumferential portion of the cylindrical body, the second portion having a second thermal conductivity, the first thermal conductivity being greater than the second thermal conductivity.

2. The cylinder liner of claim 1, wherein the first portion includes a plurality of as-cast projections.

3. The cylinder liner of claim 2, wherein the plurality of as-cast projections includes projections having a first diameter adjacent to the surface of the cylinder liner, a second diameter spaced apart from the first diameter and terminating at an end of the projection, and a third diameter therebetween less than the first and the second diameters.

4. The cylinder liner of claim 2, wherein the plurality of as-cast projections includes conjoined projections, each of the conjoined projections having a plurality of peaks, each peak sharing a shoulder with another peak.

5. The cylinder liner of claim 2, wherein the plurality of as-cast projections includes vermicular projections, each of the vermicular projections having a non-circular cross-section substantially planar to the outer surface.

6. The cylinder liner of claim 2, wherein the plurality of as-cast projections includes: projections having a first diameter adjacent to the surface of the cylinder liner, a second diameter spaced apart from the first diameter and terminating at an end of the projection, and a third diameter therebetween less than the first and the second diameters; conjoined projections, each of the conjoined projections having a plurality of peaks, each peak sharing a shoulder with another peak; and vermicular projections, each of the vermicular projections having a non-circular cross-section substantially planar to the outer surface.

7. The cylinder liner of claim 1, wherein the first portion includes a coating.

8. The cylinder liner of claim 7, wherein the coating includes aluminum.

9. The cylinder liner of claim 8, wherein the coating further includes magnesium.

10. The cylinder liner of claim 1, wherein the first portion includes a first plurality of as-cast projections and the second portion includes a second plurality of as-cast projections, the first plurality of as-cast projections having a greater average height than the second plurality of as-cast projections.

11. The cylinder liner of claim 1, wherein the second portion is devoid of as-cast projections.

12. The cylinder liner of claim 1, wherein the second portion is defined by a substantially smooth surface.

13. The cylinder liner of claim 1, wherein the second portion includes a ribbed surface.

14. The cylinder liner of claim 1, wherein the second portion includes a threaded surface.

15. The cylinder liner of claim 1, further comprising a third portion on the outer surface of the cylindrical body, the third portion having a third thermal conductivity.

16. A cylinder liner having varied thermal conductivity comprising: a cylindrical body; an outer surface of the cylindrical body; a first portion including a plurality of as-cast projections on the outer surface of the cylindrical body, wherein the plurality of as-cast projections includes projections having a first diameter adjacent to the surface of the cylinder liner, a second diameter spaced apart from the first diameter and terminating at an end of the projection, and a third diameter therebetween less than the first and the second diameters, the first portion comprising a majority of the outer surface of the cylindrical body, the first portion having a first thermal conductivity; and a second portion on the outer surface of the cylindrical body, the second portion having a second thermal conductivity different from the first thermal conductivity.

17. The cylinder liner of claim 16, wherein the first portion is adjacent a first end of the cylindrical body and the second portion is adjacent a second end of the cylindrical body.

18. A cylinder liner having varied thermal conductivity comprising: a cylindrical body having a height; an outer surface of the cylindrical body; a first circumferential portion on the outer surface of the cylindrical body, the first circumferential portion including greater than half the height of the cylindrical body, the first circumferential portion having a first thermal conductivity, wherein the first portion includes a plurality of as-cast projections, wherein the plurality of as-cast projections includes projections having a first diameter adjacent to the surface of the cylinder liner, a second diameter spaced apart from the first diameter and terminating at an end of the projection, and a third diameter therebetween less than the first and the second diameters; and a second circumferential portion on the outer surface of the cylindrical body, the second circumferential portion having a second thermal conductivity different from the first thermal conductivity.

19. A cylinder liner having varied thermal conductivity comprising: a cylindrical body having a height; an outer surface of the cylindrical body; a first circumferential portion on the outer surface of the cylindrical body, the first circumferential portion including greater than half the height of the cylindrical body, the first circumferential portion having a first thermal conductivity, wherein the first portion includes a plurality of as-cast projections, wherein the plurality of as-cast projections includes: projections having a first diameter adjacent to the surface of the cylinder liner, a second diameter spaced apart from the first diameter and terminating at an end of the projection, and a third diameter therebetween less than the first and the second diameters; conjoined projections, each of the conjoined projections having a plurality of peaks, each peak sharing a shoulder with another peak; and vermicular projections, each of the vermicular projections having a non-circular cross-section substantially planar to the outer surface; and a second circumferential portion on the outer surface of the cylindrical body, the second circumferential portion having a second thermal conductivity different from the first thermal conductivity.

* * * * *